US010538975B2

(12) United States Patent
Rodriguez et al.

(10) Patent No.: US 10,538,975 B2
(45) Date of Patent: Jan. 21, 2020

(54) LOW PROFILE STOP COLLAR

(71) Applicant: Weatherford Technology Holdings, LLC, Houston, TX (US)

(72) Inventors: Samuel Rodriguez, Cypress, TX (US); Forrest Parker, Manvel, TX (US); Maxime R. Rodrigue, Vacherie, LA (US); Philip E. Dufrene, Houma, LA (US); Vimalkumar Engineer, Richmond, TX (US); Sarah Adams, Thibodaux, LA (US)

(73) Assignee: Weatherford Technology Holdings, LLC, Houston, TX (US)

( * ) Notice: Subject to any disclaimer, the term of this patent is extended or adjusted under 35 U.S.C. 154(b) by 261 days.

(21) Appl. No.: 15/364,395

(22) Filed: Nov. 30, 2016

(65) Prior Publication Data

US 2018/0148982 A1 May 31, 2018

(51) Int. Cl.
*E21B 17/10* (2006.01)

(52) U.S. Cl.
CPC ..... *E21B 17/1028* (2013.01)

(58) Field of Classification Search
CPC ... E21B 17/1028; E21B 17/10; E21B 17/1014
See application file for complete search history.

(56) References Cited

U.S. PATENT DOCUMENTS

| | | | | |
|---|---|---|---|---|
| 327,793 | A | 10/1885 | Hall | |
| 1,822,887 | A | 9/1931 | Hagstedt | |
| 2,855,052 | A * | 10/1958 | Wright | E21B 37/02 166/172 |
| 2,872,226 | A * | 2/1959 | Wright | E21B 17/1028 166/243 |
| 3,040,405 | A | 6/1962 | Solum | |
| 3,887,990 | A | 6/1975 | Wilson | |
| 4,630,690 | A | 12/1986 | Beasley et al. | |
| 5,706,894 | A | 1/1998 | Hawkins | |
| 5,860,760 | A | 1/1999 | Kirk | |
| 8,763,690 | B2 | 7/2014 | Buytaert et al. | |
| 8,832,906 | B2 | 9/2014 | Buytaert et al. | |
| 8,851,168 | B2 | 10/2014 | Buytaert et al. | |
| 8,863,834 | B2 | 10/2014 | Buytaert et al. | |
| 9,322,228 | B2 | 4/2016 | Davila et al. | |
| 2009/0255666 | A1 * | 10/2009 | Olsen | E21B 17/1028 166/208 |
| 2010/0326671 | A1 * | 12/2010 | Buytaert | B25B 27/10 166/378 |
| 2015/0191982 | A1 | 7/2015 | Steine | |

* cited by examiner

*Primary Examiner* — Caroline N Butcher

(74) *Attorney, Agent, or Firm* — Patterson + Sheridan, LLP

(57) ABSTRACT

A stop collar for a tubular includes an inner ring configured to engage the tubular and having a waveform profile. The waveform profile includes a peak and a base. The stop collar includes an outer ring configured to be disposed around the inner ring and configured to compress the inner ring. A method for assembling a stop collar for a centralizer on a tubular includes positioning an inner ring around the tubular, the inner ring including a profile and compressing the profile against the tubular by disposing an outer ring around the inner ring.

22 Claims, 8 Drawing Sheets

LOW PROFILE STOP COLLAR

BACKGROUND OF THE INVENTION

Field of the Invention

Embodiments of the invention generally relate to stop collars for use on a wellbore tubular.

Description of the Related Art

A wellbore is formed to access hydrocarbon bearing formations, such as crude oil and/or natural gas, by the use of drilling. Drilling is accomplished by utilizing a drill bit that is mounted on the end of a drill string. To drill within the wellbore to a predetermined depth, the drill string is often rotated by a top drive or rotary table on a surface platform or rig, and/or by a downhole motor mounted towards the lower end of the drill string. After drilling to a predetermined depth, the drill string and drill bit are removed and a casing string is lowered into the wellbore. An annulus is formed between the string of casing and the wellbore. The casing string is cemented into the wellbore by circulating cement slurry into the annulus. The combination of cement and casing strengthens the wellbore and facilitates the isolation of certain formations behind the casing for the production of hydrocarbons.

Centralizers are mounted on the casing string to center the casing string in the wellbore and obtain a uniform thickness cement sheath around the casing string. Multiple centralizers are spaced apart along the casing string to provide centralization of the casing string at multiple points throughout the wellbore. Each centralizer has blades extending out from the casing wall and contacting the wellbore, thereby holding the casing string off of direct contact with the wellbore wall, and substantially centralizing the casing therein. To accomplish that goal, the centralizer blades typically form a total centralizer diameter roughly the diameter of the wellbore in which the casing string is run.

One type of centralizer has a solid central tubular body having a plurality of solid blades integral with the central body, the blades extending out to the desired diameter. Another type is a bow spring centralizer having a pair of spaced-apart bands locked into place on the casing, and a number of outwardly bowed, resilient bow spring blades connecting the two bands and spaced around the circumference of the bands. The bow spring centralizers are capable of at least partially collapsing as the casing string passes through any restricted diameter location, such as a piece of equipment having an inner diameter smaller than the at-rest bow spring diameter, and then springing back out after passage through the restricted diameter location.

Stop collars are mounted on the casing string to restrict longitudinal movement of the centralizer on the casing string. A stop collar mounted above the centralizer on the casing string restricts upward movement of the centralizer while lowering the casing string into the wellbore. Likewise, a stop collar mounted below the centralizer on the casing string restricts downward movement of the centralizer while lifting the casing string in the wellbore. Conventional stop collars may catch and interfere with a wall of the wellbore in restricted diameter locations. Conventional stop collars may also require fasteners to attach to a casing string. Fasteners, such as screws, may scratch and damage an outer surface of the casing string. Conventional stop collars may also require measurement of each section of the casing string and custom manufacturing to ensure a suitable fit between the stop collar and the casing string. Because stop collars are mounted to the exterior of the casing string, the stop collar adds to the overall outer diameter of the casing string. There is a need for stop collars having a low profile to pass through restricted diameter locations in the wellbore, stop collars which can accommodate for variances in sections of the casing string, and different methods for attaching stop collars to prevent damaging the casing string.

SUMMARY OF THE INVENTION

In one or more of the embodiments described herein, a stop collar for a tubular includes an inner ring configured to engage the tubular and having a waveform profile. The waveform profile includes a peak and a base. The stop collar includes an outer ring configured to be disposed around the inner ring and configured to compress the inner ring.

In another embodiment, a stop collar for a centralizer includes an inner ring configured to engage a tubular including a profile having a peak and a base. The stop collar includes an outer ring configured to compress the profile.

In another embodiment, a method for assembling a stop collar for a centralizer on a tubular includes positioning an inner ring around the tubular, the inner ring including a profile and compressing the profile against the tubular by disposing an outer ring around the inner ring.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
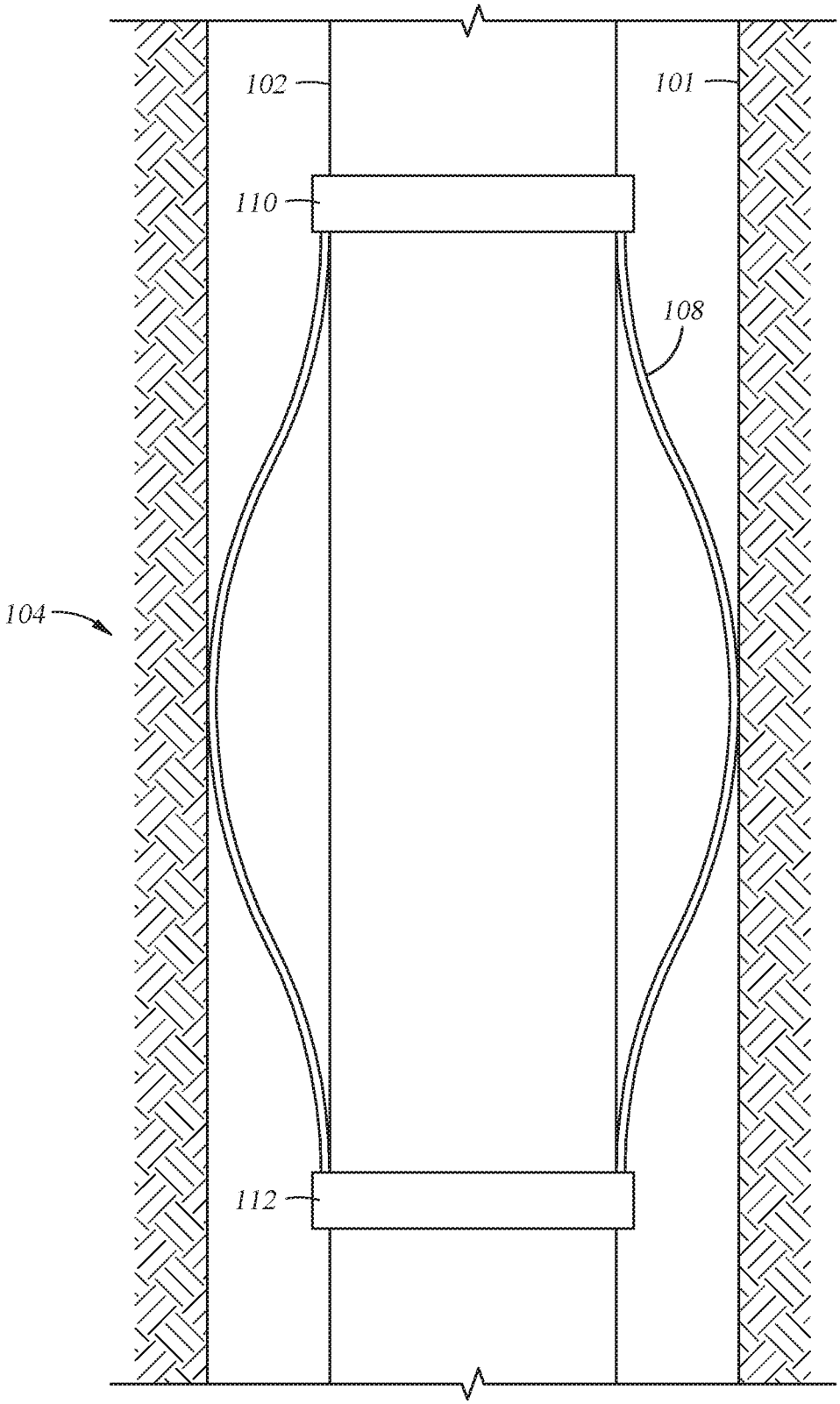
FIG. 1 is a cross-sectional side view of a casing string section in a wellbore with a centralizer between stop collars.

Referring to FIG. 1, when running a tubular, such as a casing string 102 or drill pipe, in a wellbore 101, centralizers can be used to center the casing string 102 in the wellbore 101. FIG. 1 illustrates a centralizer assembly 104. The centralizer assembly 104 includes a centralizer 108 with centralizer bow springs that extend radially outward to contact the wellbore 101. The centralizer assembly 104 also includes a first stop collar 110 and a second stop collar 112. The centralizer 108 is positioned between the first stop collar 110 and the second stop collar 112. The stop collars 110 and 112 are attached to the casing string 102 and constrain the centralizer 108 along the casing string 102 between the stop collars 110 and 112.

Figure 2A:
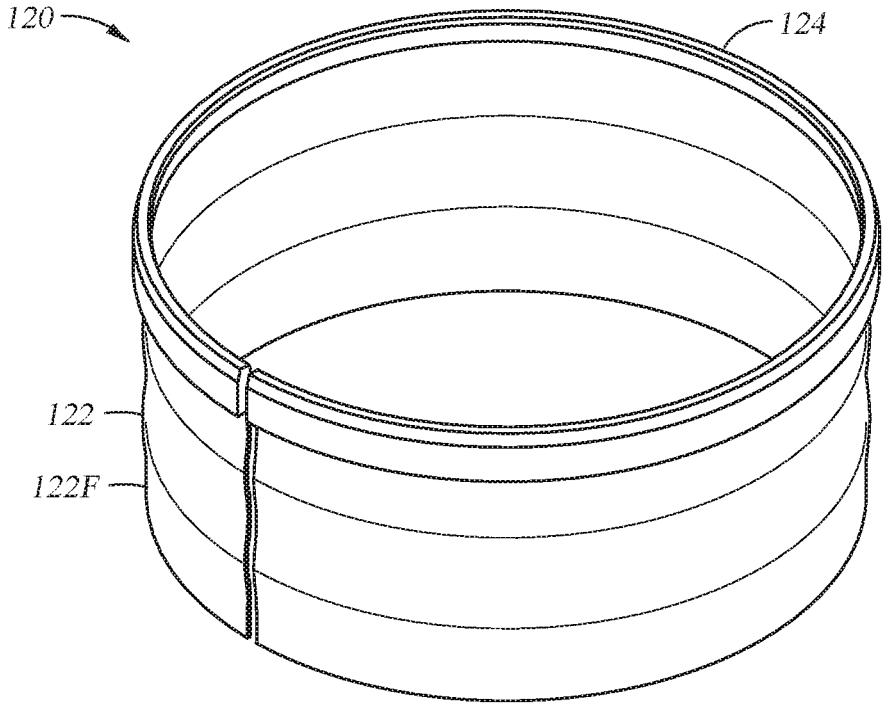
FIG. 2A is a perspective view of a first ring of a stop collar, according to one embodiment according to one embodiment of the present invention.
Figure 2B:
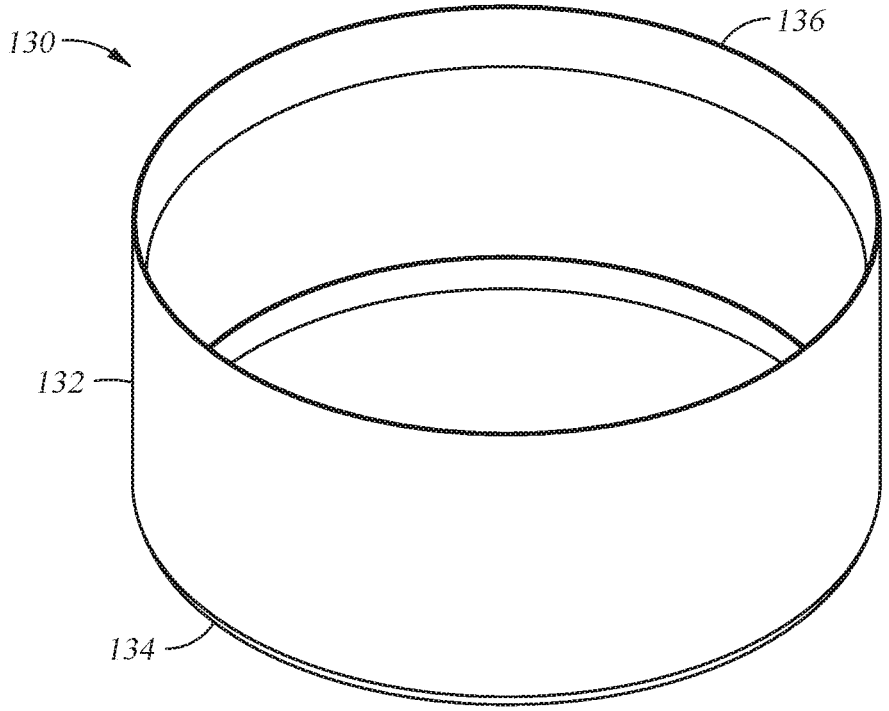
FIG. 2B is a perspective view of a second ring of the stop collar, according to one embodiment of the present invention.
Figure 3:
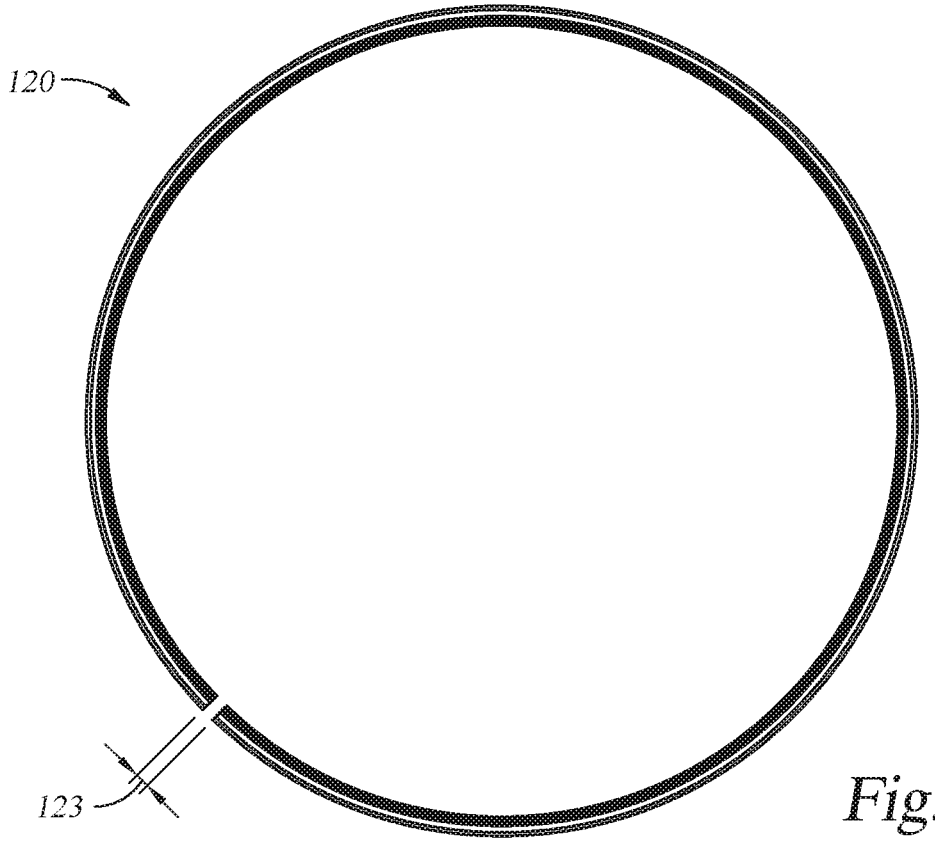
FIG. 3 is a top-down view of the first ring of the stop collar.

Referring to FIG. 2A and 2B, an exemplary stop collar 210 includes a first ring 120 and a second ring 130. The first ring 120 may be metal. The first ring 120 may be an inner ring. The first ring 120 may include a split ring 122 and a shoulder 124. As seen in FIG. 3, the split ring 122 may have a longitudinal gap 123 formed through a wall thereof. The longitudinal gap 123 may be formed in the split ring 122 adjacent circumferential ends thereof. The longitudinal gap 123 can facilitate placement of the split ring 122 on the casing string 102. For example, the longitudinal gap 123 can accommodate for variances of an outer diameter of the casing string 102. Variances of the outer diameter of the casing string 102 may be the result of manufacturing tolerances during manufacture of the casing. The shoulder 124 may have a longitudinal gap formed through a wall thereof corresponding with the gap 123 in the split ring 122. The first ring 120 may be disposed about an outer surface of the casing string 102.

Figure 5:
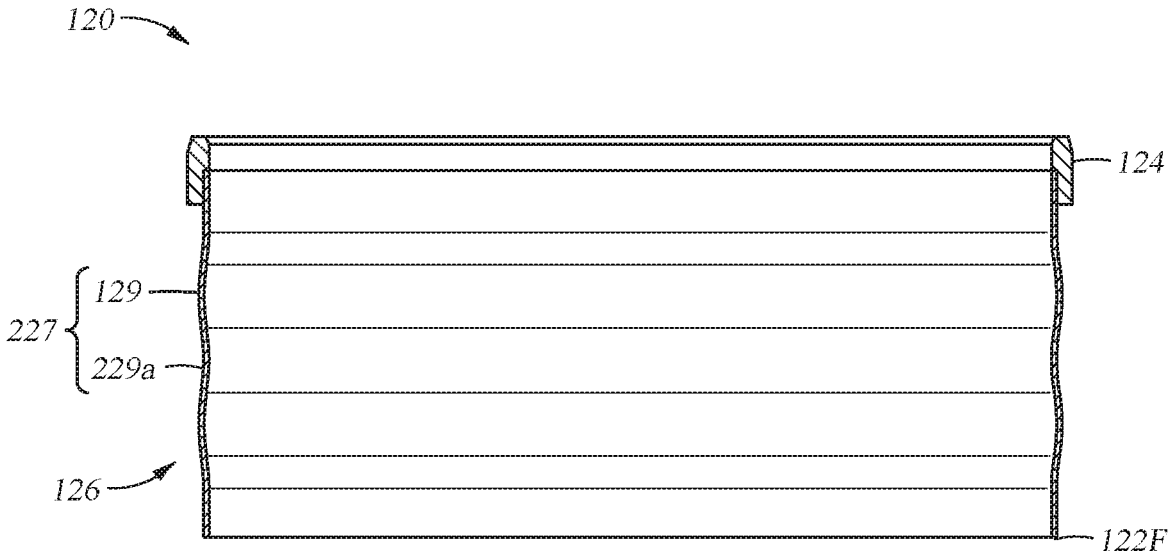
FIG. 5 is a cross-sectional view of the first ring of the stop collar.
Figure 6:
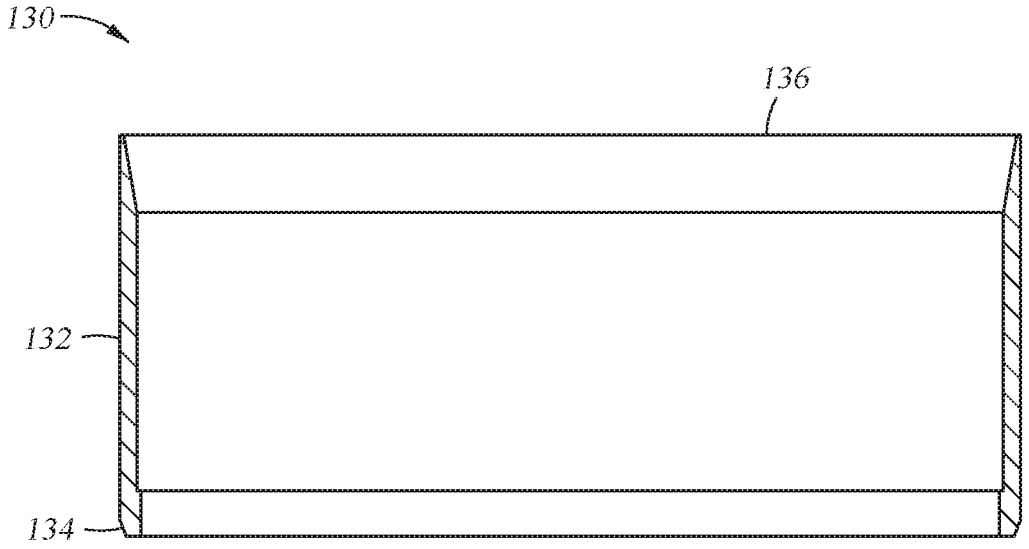
FIG. 6 is a cross-sectional view of the second ring of the stop collar.

As seen in FIG. 5, the split ring 122 may have a profile 126 formed therein. In this embodiment, the profile 126 is a waveform profile, such as a sinusoidal profile. The waveform profile is formed in an inner surface and an outer surface of the profile 126. In one embodiment, the waveform profile may be formed only along an inner surface of the profile 126. An outer surface of the waveform profile may be substantially straight. In another embodiment, the waveform profile may be formed only along the outer surface of the profile 126. The inner surface of the profile 126 may be substantially straight. Alternatively, the profile 126 may have any shape including a peak and a base. In one embodiment, the profile 126 may include projections formed on an inner surface thereof. The projections may be rounded protrusions. The projections may be arranged in a square pattern on the inner surface of the profile 126. The projections may be configured to engage the casing string 102. In other embodiments, the profile 126 may include teeth-shaped projections formed on the inner surface thereof. The teeth-shaped projections may be configured to engage the casing string 102. The teeth-shaped projections may be formed along the base of the profile 126. The profile 126 may accommodate for variances of an outer diameter of the casing string 102. The profile 126 is deformable to accommodate for manufacturing variances of the outer diameter of the casing string 102. The profile 126 may be heat treated to provide spring resiliency. The profile 126 includes at least one wave 127. The wave 127 may include a base 128 and a peak 129. Each base 128 may engage the outer surface of the casing string 102. Each peak 129 may have a clearance 129*p*, shown in FIG. 9, formed between the outer surface of the casing string 102 and the peak 129. The waveform profile may be aligned in any orientation relative to the casing string 102. In one embodiment, the waveform profile may be aligned longitudinally relative to the casing string 102. In this orientation, each base 128 engages an outer surface of the casing string 102 along an outer circumference of the casing string 102. In another embodiment, the waveform profile may be aligned circumferentially relative to the casing string 102. In this orientation, each base 128 engages the outer surface of the casing string 102 perpendicular to the outer circumference of the casing string 102. An inner surface of the profile 126 may be coated with a friction enhancing substance, such as welding slag. The friction enhancing substance may prevent damaging and scratching an outer surface of the casing string 102. The split ring 122 may have slots (not shown) formed in a wall thereof. The slots can be formed along the peak 129 of the split ring 122. The slots may facilitate expansion of the split ring 122 during placement of the split ring 122 on the casing string 102. The slots may be aligned in any orientation relative to the base 128. In one embodiment, the slots may be aligned parallel to the base 128. In another embodiment, the slots may be aligned perpendicular to the base 128. The split ring 122 may have a straight flange 122*f* formed at a longitudinal end thereof opposite the shoulder 124. The straight flange 122*f* can facilitate the second ring 130 sliding over the profile 126.

The shoulder 124 may be tapered at a longitudinal end thereof opposite the split ring 122. The tapered end of the shoulder 124 may facilitate the stop collar 110 passing through a restricted diameter location in the wellbore 101. The split ring 122 may be connected to the shoulder 124 at a longitudinal end thereof opposite the flange 122*f*. The split ring 122 may be welded to the shoulder 124. Alternatively, the shoulder 124 may be integral with the split ring 122.

Figure 4:
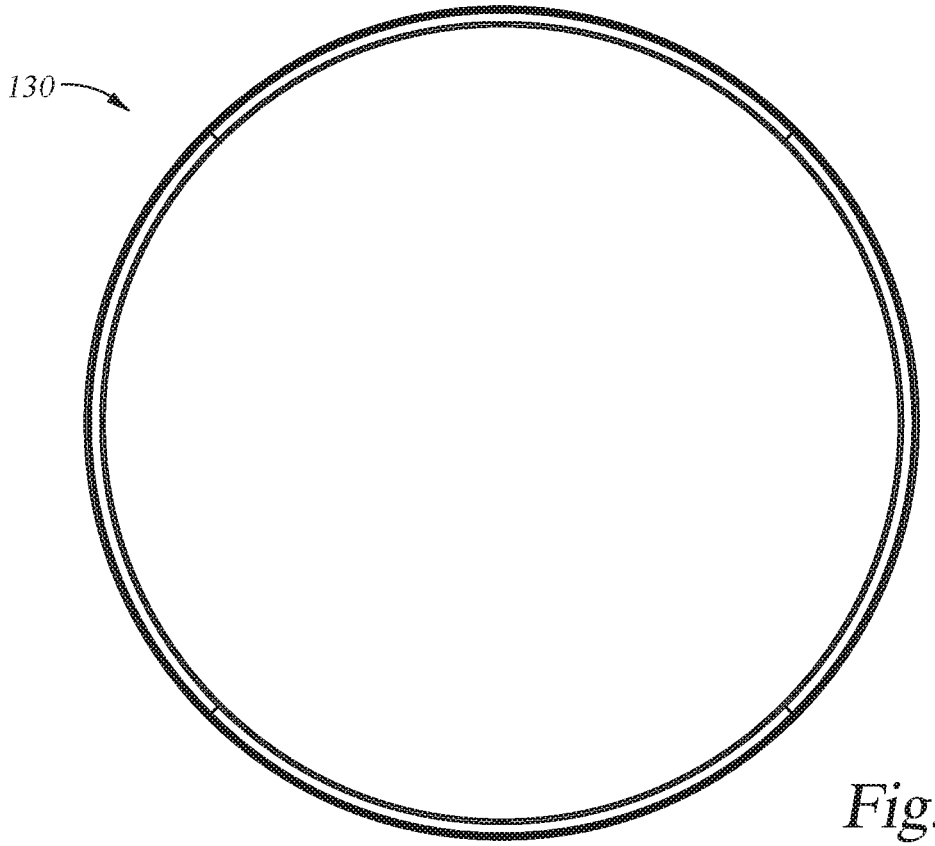
FIG. 4 is a top-down view of the second ring of the stop collar.

Referring to FIG. 2B and 4, the second ring 130 may be an outer ring. The second ring 130 may be metal. The second ring 130 may include a solid ring 132, a shoulder 134, and a lip 136. The solid ring 132 may have a bore therethrough. The solid ring 132 may be a rigid sleeve having no gap formed through a wall thereof. The solid ring 132 may have an inner diameter slightly less than an outer diameter of the split ring 122 at the peak 129. The lip 136 may have a tapered edge at a longitudinal end thereof facing the split ring 122. The tapered edge may facilitate sliding the second ring 130 over the first ring 120. The shoulder 134 may be formed at a longitudinal end of the solid ring 132 opposite the lip 136 and proximate the centralizer 108. The shoulder 134 may be connected to the solid ring 132. Alternatively, the shoulder 134 may be integral to the solid ring 132. The shoulder 134 has a tapered edge at a longitudinal end thereof opposite the solid ring 132. The tapered edge facilitates the stop collar 110 passing through a restricted diameter location in the wellbore 101. The second ring 130 may be disposed about an outer surface of the casing string 102. The second ring 130 may be disposed around the first ring 120.

Figure 7:
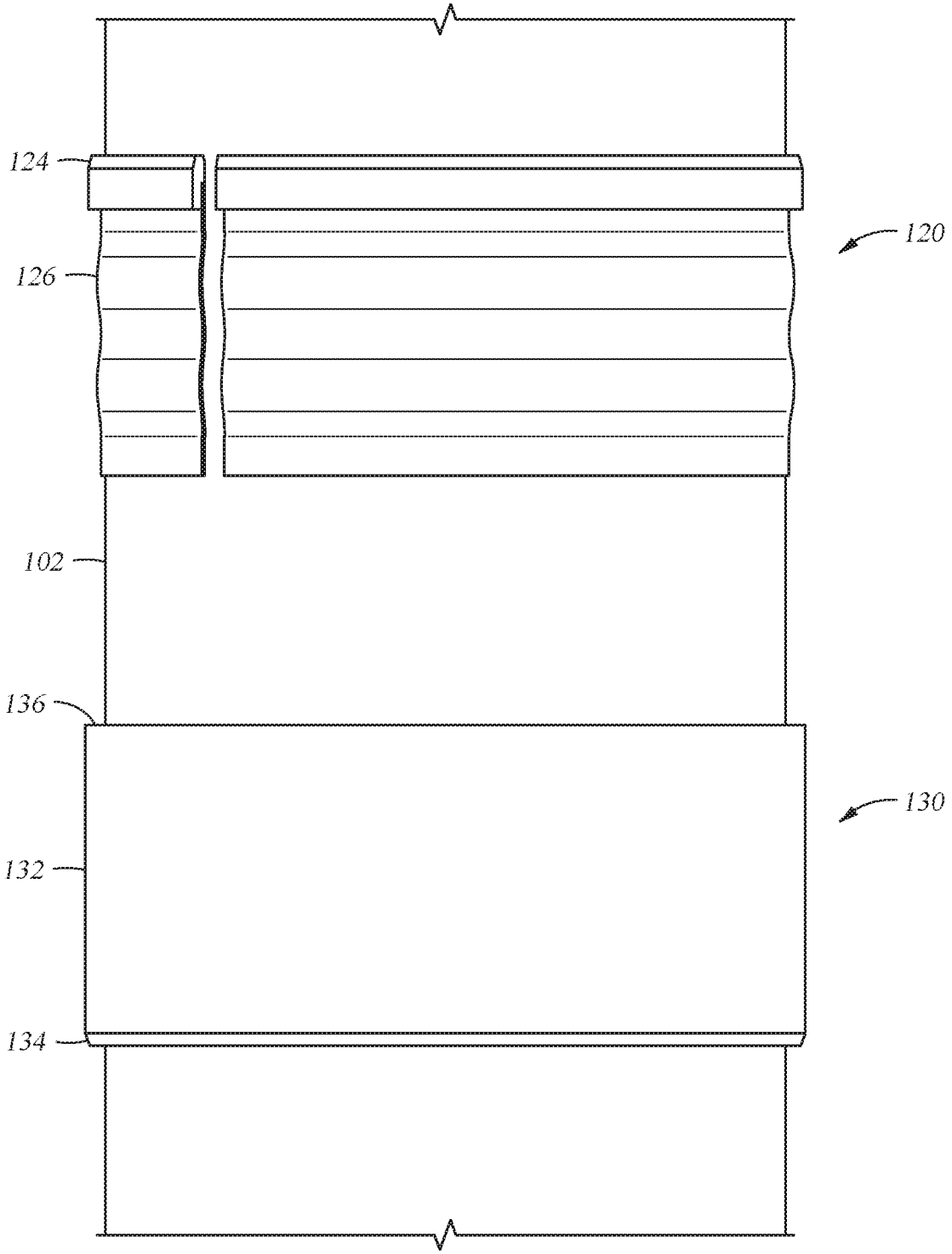
FIG. 7 illustrates a perspective view of the stop collar on a casing string
Figure 8:
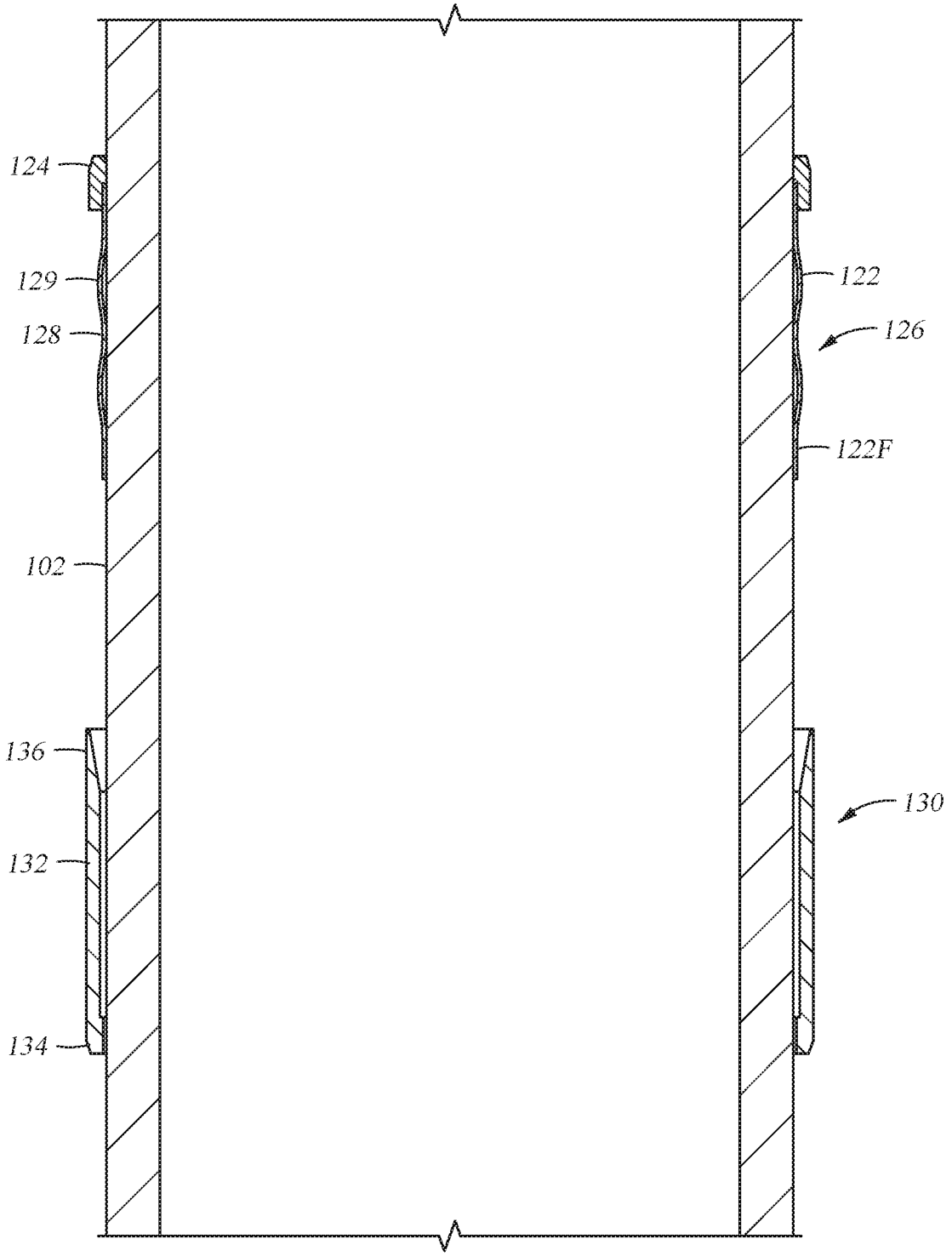
FIG. 8 illustrates a cross-sectional view of the stop collar on the casing string.
Figure 9:
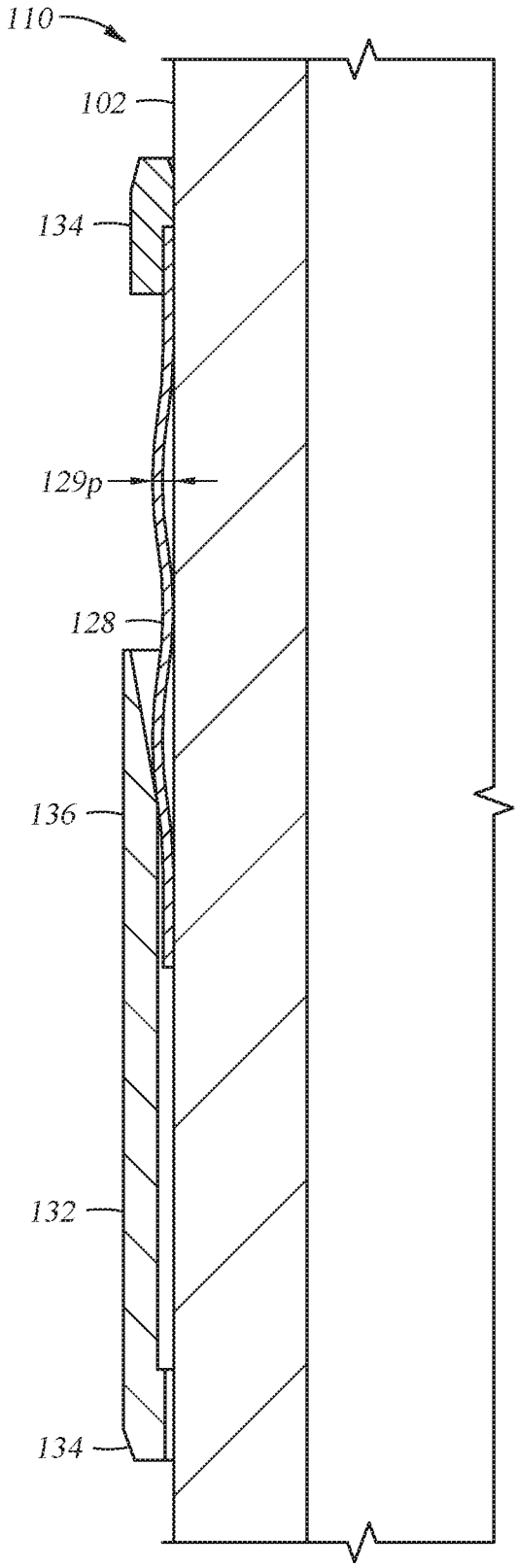
FIGS. 9 and 10 illustrate assembly of the first ring and second ring of the stop collar, according to one embodiment of the present invention.
Figure 10:
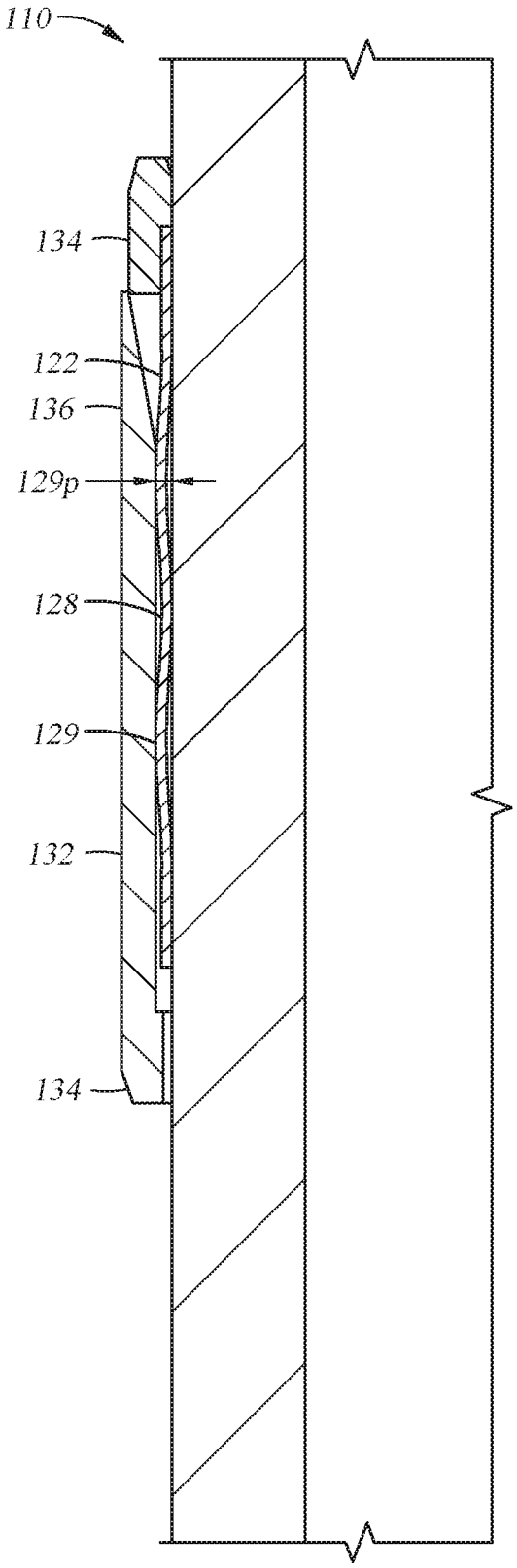

As shown in FIG. 7, the first ring 120 of the first stop collar is slid over the casing string 102 and moved into a desired position. The desired position of the first stop collar is chosen based on a spacing of the centralizers along the casing string 102. The first ring 120 is slid over the casing string 102 with the shoulder 124 facing away from the location of the centralizer. The second ring 130 of the first stop collar is then slid over the casing string 102 with the lip 136 facing towards the first ring 120. As shown in FIG. 8, the straight flange 122*f* of the split ring 122 faces the solid ring 132 before assembly of the stop collar 110. Next, the second ring 130 is slid over an outer surface of the first ring 120, as seen in FIG. 9. Referring to FIG. 10, the inner diameter of the solid ring 132 pushes against the peak 129 of the split ring 122. The solid ring 132 compresses the split ring 122 against the outer surface of the casing string 102. Compression of the split ring 122 against the outer surface of the casing string 102 increases the contact area and the longitudinal retaining force between the base 128 of the profile 126 and the outer surface of the casing string 102.

The base 128 of the profile 126 deforms and flattens out against the outer surface of the casing string 102 during the compression by the solid ring 132. Further, the peak 129 deforms due to the force acting on the profile 126 from the solid ring 132. Compression of the split ring 122 against the outer surface of the casing string 102 reduces the clearance 129*p* between the peak 129 of the split ring 122 and the outer surface of the casing string 102. The coating on the inner surface of the profile 126 provides additional friction to increase the longitudinal retaining force between the split ring 122 and the casing string 102, thereby restricting longitudinal movement of the assembled first stop collar 110 relative to the casing string 102. Friction between the inner surface of the solid ring 132 and the outer surface of the split ring 122 retains the solid ring 132 in place after assembly of the stop collar 110.

Next, a centralizer is disposed around the casing string 102 and adjacent to shoulder 134 of the solid ring 132. The centralizer is prevented from moving longitudinally past the assembled first stop collar 110 by engagement with the shoulder 134 of the solid ring 132. Next, a second stop collar 112 is assembled on the casing string 102 using the same process as above for the first stop collar. The second stop collar is assembled at an opposite longitudinal end of the centralizer from the first stop collar. The second stop collar is assembled on the casing string 102 a sufficient longitudinal distance from the first stop collar to allow the bow-strings of the centralizer to collapse and pass through restricted diameter locations in the wellbore 101. The second stop collar 112 is assembled with the shoulder 134 facing the centralizer.

Once both the first stop collar 110 and second stop collar 112 are assembled on the casing string, the centralizer is restricted to longitudinal movement on the casing string between the first and second stop collars 110, 112. When running the casing string into the wellbore 101, the centralizer may catch on a wall of the wellbore 101. The centralizer is forced toward one of the stop collars. The centralizer engages a shoulder of the stop collar, restricting further longitudinal movement of the centralizer relative to the casing string 102. Once the centralizer and stop collars 110, 112 have passed through the restricted diameter location of the wellbore 101, the centralizer moves down the casing string 102 to rest against the lower stop collar 112.

Alternatively, first stop collar 110 may be used in a single stop collar centralizer assembly. In this embodiment, the first stop collar 110 is assembled on the casing string 102 using a substantially similar process as described above. The centralizer is positioned over the assembled first stop collar 110. The first stop collar 110 constrains the centralizer along the casing string 102 because ends of the centralizer cannot pass over the first stop collar 110.

Figure 11:
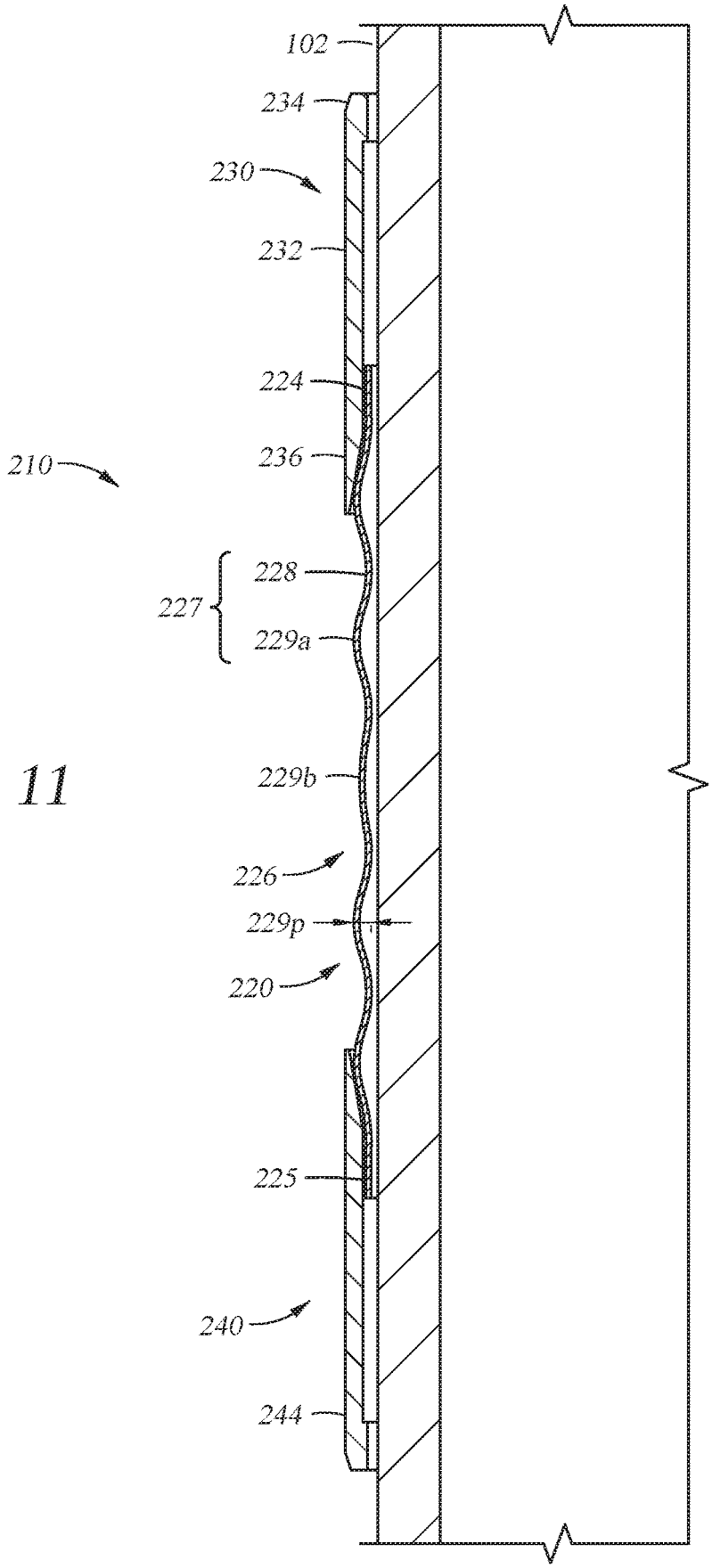
FIG. 11 illustrates assembly of a stop collar, according to another embodiment of the present invention.

Referring to FIG. 11, in another embodiment, the centralizer assembly may include a first stop collar 210 and a second stop collar. The centralizer is positioned between the first stop collar 210 and the second stop collar. The stop collars are attached to the casing string 102 and constrain the centralizer along the casing string 102 between the stop collars.

The stop collar 210 may include a first ring 220, a second ring 230, and a third ring 240. The first ring 220 may be an inner ring. The first ring 220 may include a split ring. The split ring may have a longitudinal gap formed through a wall thereof similar to split ring 122. The longitudinal gap may be formed in the split ring adjacent circumferential ends thereof. The longitudinal gap can facilitate placement of the split ring on the casing string 102. For example, the longitudinal gap can accommodate for variances of an outer diameter of the casing string 102. Variances of the outer diameter of the casing string 102 may be the result of manufacturing tolerances during manufacture of the casing. The split ring may have straight flanges 224, 225 formed at longitudinal ends thereof. The split ring is disposed about an outer surface of the casing string 102.

The split ring may has a profile 226 formed therein. An inner surface of the profile 226 may be coated with a friction enhancing substance, such as welding slag. In this embodiment, the profile 226 is a waveform profile, such as a sinusoidal profile. The waveform profile is formed in an inner surface and an outer surface of the profile 226. In one embodiment, the waveform profile may be formed only along an inner surface of the profile 226. An outer surface of the waveform profile may be substantially straight. In another embodiment, the waveform profile may be formed only along the outer surface of the profile 226. The inner surface of the profile 226 may be substantially straight. Alternatively, the profile 126 may have any shape including a peak and a base. In one embodiment, the profile 226 may include projections formed on an inner surface thereof. The projections may be rounded protrusions. The projections may be arranged in a square pattern on the inner surface of the profile 226. The projections may be configured to engage the casing string 102. In other embodiments, the profile 226 may include teeth-shaped projections formed on the inner surface thereof. The teeth-shaped projections may be configured to engage the casing string 102. The teeth-shaped projections may be formed along the base of the profile 226. Alternatively, the profile 226 may have any shape including a peak and a base. The profile 226 may be heat treated to provide spring resiliency. The profile 226 may accommodate for variances of an outer diameter of the casing string 102. The profile 226 is deformable to accommodate for manufacturing variances of the outer diameter of the casing string 102. The profile 226 includes at least one wave 227 (four are shown), each wave 227 includes a base 228 and a peak 229*a*. Each base 228 engages the outer surface of the casing string 102. Each peak 229*a* has a clearance 229*p* formed between the outer surface of the casing string 102 and the peak 229*a*. In certain embodiments, the profile 226 includes a center wave. The center wave includes a center peak 229*b*. As shown in FIG. 11, the center peak 229*b* may be disposed between at least two waves 227 in the profile 226. An inner diameter of the profile 226 at the center peak 229*b* is smaller than an inner diameter of the profile 226 at the peak 229*a*. The center peak 229*b* can deform to accommodate for manufacturing tolerances in length. Alternatively, the profile 226 may have a substantially straight center portion. The center portion of the profile 226 may be disposed between at least two waves 227 in the profile 226. The center portion can prevent buckling of the profile 226 during assembly on the casing string 102. The waveform profile is aligned in any orientation relative to the casing string 102. In one embodiment, the waveform profile may be aligned longitudinally relative to the casing string 102. In this orientation, each base 228 has several points of contact circumferentially around the outer surface of the casing string 102. In another embodiment, the waveform profile is aligned circumferentially relative to the casing string 102. In this orientation, each base 228 has several points of contact longitudinally on the outer surface of the casing string 102. The split ring may have slots (not shown) formed in a wall thereof. The slots may be formed along the peak 229*a* of the split ring. The slots can facilitate expansion of the split ring during placement of the split ring on the casing string 102. The slots may be aligned in any orientation relative to the base 228. In one embodiment, the slots are aligned parallel to the base 228. In another embodiment, the slots are aligned perpendicular to the base 228.

The flanges 224, 225 may be tapered at a longitudinal end thereof. The tapered end of the flanges 224, 225 can facilitate the second ring 230 and third ring 240 sliding over an outer diameter of the split ring.

The second ring 230 is an outer ring. Second ring 230 includes a solid ring 232, a shoulder 234, and a lip 236. The solid ring 232 may have a bore therethrough. The solid ring 232 may be a rigid sleeve having no gap formed through a wall thereof. The solid ring 232 may have an inner diameter slightly less than an outer diameter of the split ring at the peak 229*a*. The solid ring 232 may have an inner diameter slightly greater than an outer diameter of the split ring at the center peak 229*b*. The lip 236 has a tapered edge at a longitudinal end thereof opposite the shoulder 234. The tapered edge can facilitate sliding the second ring 230 over the first ring 220. The tapered edge can facilitate the placement of the lip 236 over the center peak 229*b*. The shoulder 234 is at a longitudinal end of the second ring 230 facing the centralizer. The shoulder 234 may have a tapered edge at a longitudinal end thereof facing the centralizer. The tapered edge can facilitate the stop collar 210 passing through a restricted diameter location in the wellbore 101. The second ring 230 may be disposed about the casing string 102. The second ring 230 may be disposed around the first ring 220 at a longitudinal end facing the centralizer.

The third ring 240 is substantially similar to second ring 230. The third ring 240 is an outer ring. The third ring 240 may include a shoulder 244. The shoulder 244 may have a tapered edge at a longitudinal end thereof facing away from the centralizer. The tapered edge can facilitate the stop collar 210 passing through a restricted diameter location in the wellbore 101. The third ring 240 may be disposed about the casing string 102. The third ring 240 may be disposed around the first ring 220 at a longitudinal end away from the centralizer. A combined length of the second ring 230 and third ring 240 may be greater than the length of the second ring 220 to ensure the lips of the rings 230, 240 meet during assembly of the first stop collar 210, described below. The second stop collar is substantially similar to the first stop collar 210.

In operation, a first stop collar 210 is assembled on the casing. The split ring of the first stop collar 210 is slid over the casing string 102 and moved into a desired position. The desired position of the first stop collar 210 is chosen based on a spacing of the centralizers along the casing string 102. The second ring 230 and third ring 240 of the first stop collar 210 are then slid over the casing string 102. The lip 236 of the second ring 230 faces towards the first ring 220. Likewise, a lip of the third ring 240 faces towards the first ring 220. The second ring 230 and third ring 240 may be slid over the casing string 102 one at a time or simultaneously. The second ring 230 and third ring 240 of the first stop collar are slid over an outer surface of the first ring 220. The second ring 230 and third ring 240 may be slid over the outer surface of the first ring 220 one at a time or simultaneously. The inner diameter of the solid ring 232 pushes against the peak 229*a* of the split ring. The solid ring 232 compresses the split ring against the casing string 102. Compression of the split ring against the outer surface of the casing string 102 increases the contact area and the longitudinal retaining force between the base 228 of the profile 226 and the outer surface of the casing string 102. The base 228 of the profile 226 deforms and flattens out against the outer surface of the casing string 102 during compression by the solid ring 232. Likewise, the third ring 240 operates in a similar manner to compress to split ring against the outer surface of the casing string 102. The second ring 230 and third ring 240 are slid over the first ring 220 until the lip 236 of the second ring 230 meets a lip of the third ring 240. The lips of the rings 230, 240 meet over the center wave, such as adjacent the center peak 229*b*. In addition, compressing the split ring against the outer surface of the casing string 102 reduces the size of the longitudinal gap between the circumferential ends of the split ring. Further, the peak 229*a* deforms due to the force acting on the profile 226 from the solid ring 232. Compression of the split ring against the outer surface of the casing string 102 reduces the clearance 229*p* between the peak 229*a* of the split ring and the outer surface of the casing string 102. The center peak 229*b* deforms to accommodate for manufacturing tolerances in length. The center peak 229*b* deforms due to the compression of the second ring 230 and third ring 240. The center peak 229*b* collapses, increasing the longitudinal distance between the straight flanges 224, 225. The coating on the inner surface of the profile 226 provides additional friction to increase the longitudinal retaining force between the split ring and the casing string 102, restricting longitudinal movement of the assembled first stop collar 210 relative to the casing string 102. Friction between the inner surface of the rings 230, 240 and the outer surface of the first ring 220 retains the rings 230, 240 in place after assembly of the stop collar 210.

Next, a centralizer is deployed onto the casing string 102. The centralizer is prevented from moving longitudinally past the assembled first stop collar 210 by engagement with the shoulder 234 of the solid ring 232. Next, a second stop collar is assembled on the casing string 102 using the same process as above for the first stop collar 210. The second stop collar is assembled at an opposite longitudinal end of the centralizer from the first stop collar 210. The second stop collar is assembled on the casing string 102 a sufficient longitudinal distance from the first stop collar to allow the bowstrings of the centralizer to collapse and pass through restricted diameter locations in the wellbore 101. The second stop collar is assembled with the shoulder 234 facing the centralizer.

Once both the first stop collar 210 and second stop collar are assembled on the casing string, the centralizer is restricted to longitudinal movement on the casing string between the first and second stop collar. When running the casing string into the wellbore 101, the centralizer may catch on a wall of the wellbore 101. The centralizer is forced toward one of the stop collars. The centralizer engages the shoulder 234 of the stop collar, restricting further longitudinal movement of the centralizer relative to the casing string 102. Once the centralizer and stop collars have passed through the restricted diameter section of the wellbore, the centralizer moves down the casing string 102 to rest against the lower stop collar.

Alternatively, first stop collar 210 may be used in a single stop collar centralizer assembly. In this embodiment, the first stop collar 210 is assembled on the casing string 102 using a substantially similar process as described above. The centralizer is positioned over the assembled first stop collar 210. The first stop collar 210 constrains the centralizer along the casing string 102 because ends of the centralizer cannot pass over the first stop collar 110.

In one or more of the embodiments described herein, a stop collar for a tubular includes an inner ring configured to engage the tubular and having a waveform profile. The waveform profile includes a peak and a base. The stop collar includes an outer ring configured to be disposed around the inner ring and configured to compress the inner ring.

In one or more of the embodiments described herein, the stop collar includes a second outer ring disposed around the inner ring and configured to compress the inner ring.

In one or more of the embodiments described herein, the base is aligned circumferentially relative to the tubular.

In one or more of the embodiments described herein, the outer ring includes a shoulder, the shoulder configured to prevent longitudinal movement of a centralizer.

In one or more of the embodiments described herein, the peak includes a clearance from the outer surface of the tubular.

In one or more of the embodiments described herein, the peak is compressible to decrease the clearance from the outer surface of the tubular.

In one or more of the embodiments described herein, the waveform profile is a sinusoidal profile.

In one or more of the embodiments described herein, the inner ring is a split ring.

In one or more of the embodiments described herein, the outer ring compresses the inner ring into the tubular is configured to compress the peak.

In one or more of the embodiments described herein, a stop collar for a centralizer includes an inner ring disposed about a tubular including a profile having a peak and a base. The stop collar includes an outer ring configured to compress the profile.

In one or more of the embodiments described herein, an inner surface of the inner ring includes a coating configured to create friction against the tubular.

In one or more of the embodiments described herein, the inner ring is a split ring.

In one or more of the embodiments described herein, wherein the outer ring is disposed around the inner ring.

In one or more of the embodiments described herein, the base is deformable.

In one or more of the embodiments described herein, the profile is a sinusoidal profile.

In one or more of the embodiments described herein, a method for assembling a stop collar for a centralizer on a tubular includes positioning an inner ring around the tubular, the inner ring including a profile and compressing the profile against the tubular by disposing an outer ring around the inner ring.

In one or more of the embodiments described herein, the method includes compressing the profile against the tubular by disposing a second outer ring around the inner ring.

In one or more of the embodiments described herein, the profile includes a peak and a base.

In one or more of the embodiments described herein, an inner diameter of the outer ring is less than an inner diameter of the peak of the outer ring.

While the foregoing is directed to embodiments of the present invention, other and further embodiments of the invention may be devised without departing from the basic scope thereof, and the scope thereof is determined by the claims that follow.

The invention claimed is:

1. A stop collar for a tubular, comprising:

an inner ring configured to engage the tubular and having an inner surface, the inner surface including at least one peak and one base; and an outer ring configured to be disposed around the inner ring and configured to compress the inner ring, wherein the at least one peak is flattened and elongated upon compression.

2. The stop collar of claim 1, further comprising a second outer ring disposed around the inner ring and configured to compress the inner ring.

3. The stop collar of claim 1, wherein at least one base is aligned circumferentially relative to the tubular.

4. The stop collar of claim 1, the outer ring having a shoulder, the shoulder configured to prevent longitudinal movement of a centralizer.

5. The stop collar of claim 1, wherein the at least one peak has a clearance from the outer surface of the tubular prior to compression.

6. The stop collar of claim 5, wherein the clearance of at least one peak is decreased when flattened by the outer ring.

7. The stop collar of claim 6, wherein the outer ring is configured to compress the at least one peak.

8. The stop collar of claim 1, wherein the inner surface is a waveform profile, wherein the waveform profile is a sinusoidal profile.

9. The stop collar of claim 1, wherein the inner ring is a split ring.

10. The stop collar of claim 1, the inner ring having a shoulder positioned at an end of the outer diameter of the inner ring, the shoulder configured to prevent longitudinal movement of the outer ring with respect to the inner ring.

11. The stop collar of claim 1, wherein the inner ring includes an outer surface having at least one peak and one base.

12. A stop collar for a centralizer, comprising:

an inner ring configured to engage a tubular, the inner ring including:

an inner surface profile having at least one peak and one base; and a shoulder at an end of an outer surface of the inner ring; and an outer ring configured to compress the inner surface profile, wherein the inner ring is elongated when compressed.

13. The stop collar of claim 12, wherein the inner surface of the inner ring includes a coating configured to increase friction against the tubular.

14. The stop collar of claim 12, wherein the inner ring is a split ring.

15. The stop collar of claim 12, wherein the outer ring is disposed around the inner ring.

16. The stop collar of claim 12, wherein at least one of the bases is deformable.

17. The stop collar of claim 12, wherein the inner surface profile is a sinusoidal profile.

18. The stop collar of claim 12, wherein the inner ring includes an outer surface profile having at least one peak and one base.

19. A method of assembling a stop collar for a centralizer on a tubular, comprising:

positioning an inner ring around the tubular, the inner ring including an inner surface profile having at least one peak and one base; and compressing the profile against the tubular by disposing an outer ring around the inner ring, thereby flattening the at least one peak and one base and elongating the inner ring.

20. The method of claim 19, further comprising compressing the profile against the tubular by disposing a second outer ring around the inner ring.

21. The method of claim 19, wherein an inner diameter of the outer ring is less than an inner diameter of the peak of the inner ring.

22. The method of claim 19, wherein the inner ring includes an outer surface profile having at least one peak and one base.

* * * * *